US010458770B1

(12) United States Patent
Wilhelm et al.

(10) Patent No.: US 10,458,770 B1
(45) Date of Patent: Oct. 29, 2019

(54) INFLATABLE TOOL FOR PLASMA GENERATION AND SHAPED CHARGE STAND-OFF

(71) Applicant: The United States of America As Represented by the Secretary of the Navy, Indian Head, MD (US)

(72) Inventors: Christopher Wilhelm, Port Tobacco, MD (US); Samuel Emery, Indian Head, MD (US); Paul Giannuzzi, Bryans Road, MD (US); Daniel McCarthy, LaPlata, MD (US); Lesley Wilhelm, Port Tobacco, MD (US)

( * ) Notice: Subject to any disclaimer, the term of this patent is extended or adjusted under 35 U.S.C. 154(b) by 0 days.

(21) Appl. No.: 15/932,015

(22) Filed: Jan. 25, 2018

(51) Int. Cl.
*F42D 5/04* (2006.01)
*F42B 33/06* (2006.01)
*F41H 11/12* (2011.01)

(52) U.S. Cl.
CPC ..... *F42D 5/04* (2013.01); *F41H 11/12* (2013.01); *F42B 33/067* (2013.01)

(58) Field of Classification Search
CPC ..... F42D 5/04; F41H 11/12; F42B 33/067
See application file for complete search history.

(56) References Cited

U.S. PATENT DOCUMENTS 3,815,646 A * 6/1974 Coakley ..... B67C 11/02 141/337
4,151,798 A 5/1979 Ridgeway
5,936,184 A 8/1999 Majerus et al.
6,979,758 B2 12/2005 Eidelman et al.
7,276,819 B1 10/2007 Whitley et al.
7,299,735 B2 * 11/2007 Alford ..... F42B 33/062 86/43
7,331,268 B1 2/2008 Pangilinan et al.
7,819,063 B1 * 10/2010 Lehman ..... B26F 3/04 102/301
7,861,744 B2 * 1/2011 Fly ..... E21B 43/105 138/93
H2259 H 7/2011 Boswell et al.
8,215,235 B2 * 7/2012 Moore ..... F42D 3/00 102/305
8,267,013 B2 * 9/2012 Moore ..... F42B 3/087 102/305
9,010,246 B2 * 4/2015 Leppanen ..... F42D 1/22 102/306
9,909,834 B1 * 3/2018 Wilhelm ..... F42B 1/02
2008/0017697 A1 * 1/2008 Kumler ..... B67C 11/02 232/43

(Continued)

OTHER PUBLICATIONS

"Inflatable Bladders and Pneumatic_Devices", Aero Tec Laboratories, p. 6—top right image (Year: 2017).*

(Continued)

*Primary Examiner* — Joshua T Semick

(57) ABSTRACT

An explosive ordnance disposal (EOD) tool has an inflated state and a deflated, collapsed state. In the inflated state, the EOD tool includes a central longitudinal axis and a radially outer portion. The radially outer portion contains an inflation composition. The radially outer portion includes an opening for admitting the inflation composition into the radially outer portion, an exterior wall and an interior wall that defines a through opening centered on the central longitudinal axis.

16 Claims, 3 Drawing Sheets

(56) References Cited

U.S. PATENT DOCUMENTS

2010/0206408 A1* 8/2010 Krohn ..... B67C 11/04
137/602

OTHER PUBLICATIONS

"Aeropress Coffee and Espresso Maker", amazon.com, p. 1 (Year: 2017).*
"Jaz Products 550-014-06 14" Triangular Funnel , amazon.com, p. 1 (Year: 2015).*
"12" ×8" Rectangular Light Gray Tamco® Funnel With 1-1/2" OD Spout | U.S. Plastic Corporation®", youtube.com, p. 1 (Year: 2017).*

* cited by examiner 10
12
14
16
18
20
22
24
38
A
B
c
d
e
W
3

INFLATABLE TOOL FOR PLASMA GENERATION AND SHAPED CHARGE STAND-OFF

STATEMENT OF GOVERNMENT INTEREST

The invention described herein may be manufactured and used by or for the Government of the United States of America for Governmental purposes without the payment of any royalties thereon or therefor.

FIELD OF THE INVENTION

The invention relates in general to explosive ordnance disposal (EOD) and in particular to tools for disposing of explosive ordnance such as, for example, improvised explosive devices (IEDs) and unexploded ordnance (UXO).

BACKGROUND OF THE INVENTION

EOD technicians perform some of the most harrowing, dangerous work to keep others from harm's way. They do so in every environment. EOD technicians may be required to parachute from aircraft, hike long distances and navigate waterways to reach their destination. The weight and size of the tools they carry is, therefore, a critical factor. There is an ongoing need for multi-purpose, space-saving and lightweight EOD tools.

SUMMARY OF THE INVENTION

One aspect of the invention is an explosive ordnance disposal (EOD) tool having an inflated state and a deflated, collapsed state. In the inflated state, the EOD tool includes a central longitudinal axis and a radially outer portion that contains an inflation composition. A plug is provided for admitting the inflation composition into the radially outer portion. The radially outer portion has an exterior wall and an interior wall. The interior wall defines a through opening centered on the central longitudinal axis. The through opening has an upper portion configured to hold a hand-loaded energetic charge or a shaped charge and a lower portion configured to act as an energetic guide for the energetic charge or the shaped charge.

The exterior wall of the radially outer portion may have various cross-sectional shapes, including a rectangular cross-section, a triangular cross-section and a hexagonal cross-section.

In one embodiment, the through opening has a cylindrical shape. In another embodiment, the upper portion of the through opening has a cylindrical shape and the lower portion of the through opening has one of a constant or decreasing cross-section. In some embodiments, the lower portion has a shape of a frustum.

Either an energetic charge or a shaped charge may be disposed in the upper portion of the through opening.

Another aspect of the invention is a method that includes providing a novel explosive ordnance disposal (EOD) tool having an inflated state and a deflated, collapsed state.

In one embodiment of the method, an energetic charge is hand-loaded in an upper portion of a through opening in the EOD tool. A shockwave having an effective velocity and temperature may be imparted on a gas in the through opening to ionize the gas for creating plasma and to drive the plasma.

After the imparting step, the plasma may impact on a casing of an explosive ordnance containing an explosive to penetrate through the casing and, at least before causing an explosive event of the explosive within the casing, substantially consume the explosive.

In another embodiment of the method, a shaped charge is loaded in the upper portion of the through opening. The shaped charge is detonated to produce a jet that moves away from the shaped charge and through the lower portion of the through opening. The jet is directed from the lower opening to impact an explosive ordnance.

The invention will be better understood, and further objects, features, and advantages thereof will become more apparent from the following description of the exemplary embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE INVENTION

Figure 5:
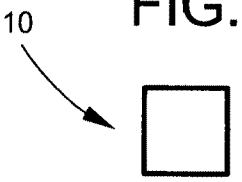
FIG. 5 is a top view of the tool of FIG. 1 in a deflated state.

An explosive ordnance disposal (EOD) tool 10 has an inflated state and a deflated, collapsed state. FIGS. 1-4 are views of tool 10 in the inflated state. FIG. 5 is a top view of tool 10 in a deflated state. In the deflated state, tool 10 may be folded into a small flat shape. In the inflated state shown in FIGS. 1-4, the EOD tool 10 includes a central longitudinal axis A and a radially outer portion 12. The radially outer portion 12 contains an inflation composition 14. The inflation composition 14 may be, for example, air or water. A plug 16 that may be opened and closed is used to fill the radially outer portion 12 with the inflation composition 14 and seal the composition 14 therein. Radially outer portion 12 includes an exterior wall 18 and an interior wall 20. Tool 10 may be made of an inflatable material, such as, for example, vinyl.

Figure 6:
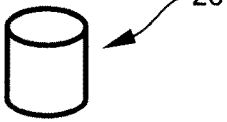
FIG. 6 is a schematic view of energetic material.
Figure 7:
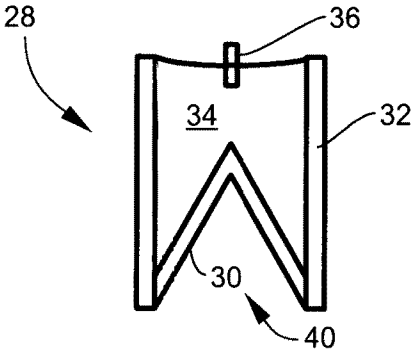
CONVENTIONAL ART FIG. 7
FIG. 7 is a cut away side view of a shaped charge.

Interior wall 20 defines a through opening 22 centered on the central longitudinal axis A. The through opening 22 has an upper portion 24 configured to hold one of a hand-loaded energetic charge 26 (FIG. 6) and a shaped charge 28 (FIG. 7). Energetic charge 26 may be, for example, C-4 explosive. Shaped charge 28 may include, for example, a liner 30 fixed in a casing 32 filled with high explosive 34. A detonator 36 may be inserted in high explosive 34. Through opening 22 has a lower portion 38 configured to act as an energetic guide for the energetic charge 26 or shaped charge 28.

Figure 9:
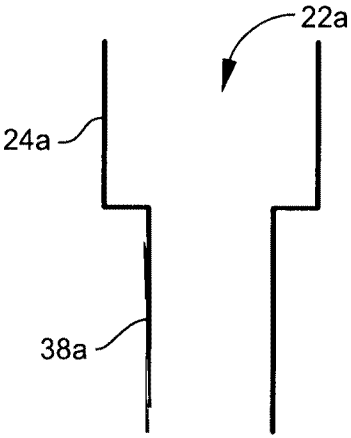
FIG. 9 is a schematic view of another embodiment of the interior walls defining a through opening in an EOD tool.
Figure 10:
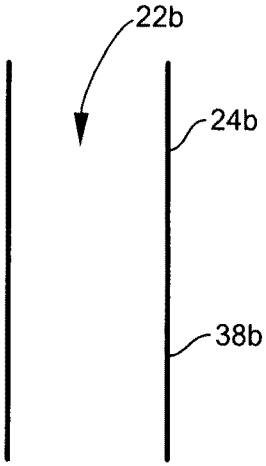
FIG. 10 is a schematic view of an additional embodiment of the interior walls defining a through opening in an EOD tool.
Figure 11:
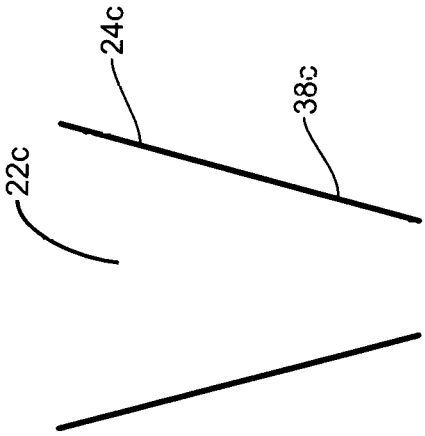
FIG. 11 is a schematic view of a further embodiment of the interior walls defining a through opening in an EOD tool.

In the embodiment of FIGS. 1-4, the upper portion 24 of through opening 22 has a cylindrical shape and the lower portion 38 of through opening 22 has the shape of a frustum of a cone. In other embodiments, the upper and lower portions may both have cylindrical shapes. For example, FIG. 9 shows a through opening 22*a* with a cylindrical upper portion 24*a* and a cylindrical lower portion 38*a* wherein the lower portion 38*a* has a smaller diameter than the upper portion 24*a*. In FIG. 10, through opening 22*b* has an upper portion 24*b* and lower portion 38*b* that are cylindrical shapes having the same diameter. In another variant shown in FIG. 11, the entire through opening 22*c* has the shape of a frustum having upper portion 24*c* and lower portion 38*c*. To function as an effective plasma generator, the diameter of the lower portion of the through opening 22 will be constant or decreasing.

Figure 13:
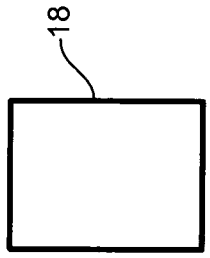
FIGS. 12-13 show different geometries for the exterior walls of an EOD tool.
Figure 12:
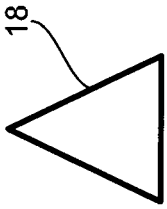

In the embodiment shown in FIGS. 1-4, the exterior wall 18 has the shape of a hexagon to allow for placing multiple tools 10 adjacent each other with a minimum amount of space between them. Exterior wall 18 may have other shapes, such as a triangle (FIG. 12) or a rectangle (FIG. 13).

Figures 1, 2, 3, 4:
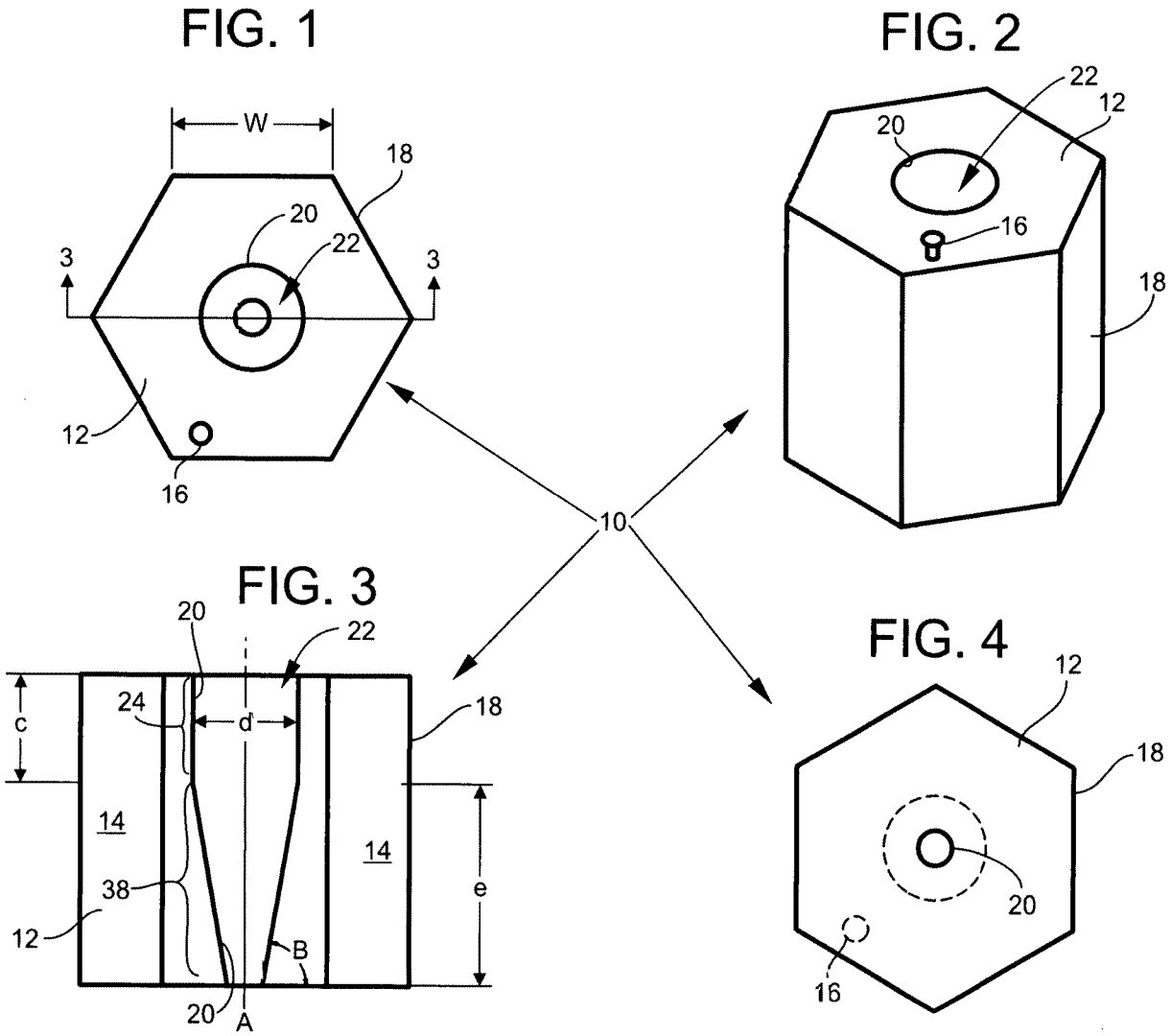
FIG. 1 is a top view of one embodiment of an explosive ordnance disposal (EOD) tool in an inflated state.
FIG. 2 is a perspective view of the tool of FIG. 1.
FIG. 3 is a sectional view taken along the line 3-3 of FIG. 1.
FIG. 4 is a bottom view of the tool of FIG. 1.

As seen in FIG. 3, the angle B between wall 20 of the lower portion 38 and the horizontal may be in a range of from less than 90 degrees to about 50 degrees. In an exemplary embodiment, the angle B is in the range of about 85 degrees to about 70 degrees. In one embodiment, the diameter d of the upper portion 24 is about 2 inches, a height c of the upper portion 24 is about 2 inches, a height e of the lower portion 38 is about 3 and ¾ inches and a width w (FIG. 1) of one hexagonal face of exterior wall 18 is about 3 inches.

One manner of using tool 10 includes hand-loading an energetic charge 26 in the upper portion 24 of the through opening 22. Tool 10 is mounted on a surface 46 of an explosive ordnance 44 containing an explosive 48. An EOD technician detonates energetic charge 26 thereby imparting a shockwave at an effective velocity and temperature on the air in the through opening 22 to ionize the air to create plasma and to drive the plasma downward through the lower portion 38. The plasma impacts on the casing 46 of an explosive ordnance 44 containing an explosive 48 to penetrate through the casing 46. At least before causing an explosive event of the explosive 48 within the casing 46, the plasma substantially consumes the explosive 48. The energetic charge 26, in an exemplary embodiment, has a detonation velocity of at least 7 mm/microsecond. The energetic charge 26, in an exemplary embodiment, has an effective velocity of at least 6 mm/microsecond.

Figure 8:
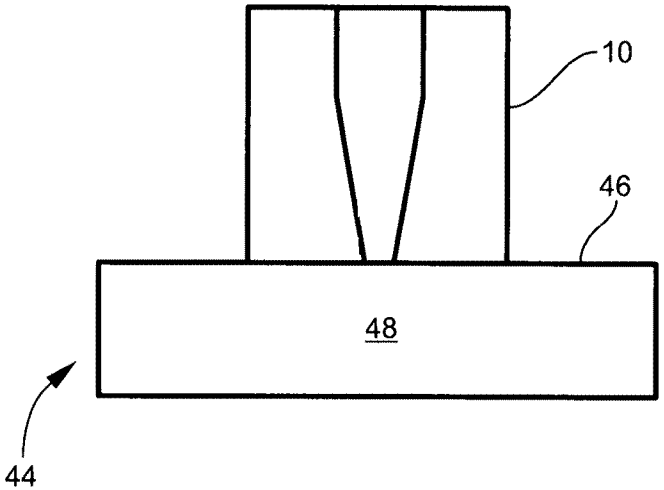
CONVENTIONAL ART FIG. 8
FIG. 8 is a cut away view of one embodiment of an EOD tool placed on the surface of an explosive ordnance.

Another manner of using tool 10 includes loading a shaped charge 28 in the upper portion 24 of the through opening 22. The open end 40 of liner 30 may rest on the bottom 42 of upper portion 24. In this way, the lower portion 38 provides a stand-off between shaped charge 28 and a surface 46 (FIG. 8) of an explosive ordnance, such as, for example, an IED or UXO. The stand-off distance is the height e of lower portion 38 of tool 10. Detonation of the shaped charge 28 produces a jet that moves away from the shaped charge 28 and through the lower portion 38 of the through opening 22. The jet is directed from the lower opening 38 to impact an explosive ordnance 44.

Any numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An apparatus, comprising:

an explosive ordnance disposal (EOD) tool including an inflated state and a deflated, collapsed state, wherein, in the inflated state, the EOD tool include a central longitudinal axis, a radially outer portion that contains an inflation composition and includes a plug to admit the inflation composition into the radially outer portion, an exterior wall and an interior wall that defines a through opening centered on the central longitudinal axis, wherein the through opening includes an upper portion configured to hold one of a hand-loaded energetic charge and a shaped charge, and a lower portion configured to act as an energetic guide for the one of the energetic charge and the shaped charge, wherein the upper portion of the through opening includes a cylindrical shape, and wherein the lower portion of the through opening includes one of a constant cross-section and a decreasing cross-section; and an energetic charge being disposed in the upper portion of the through opening, wherein the lower portion has a shape of a frustum, wherein an angle between a wall of the lower portion, and a horizontal is in a range of from less than 90 degrees to about 50 degrees, and wherein an inflation composition is one of air and water.

2. The apparatus of claim 1, wherein the through opening is a cylindrical shaped through opening.

3. The apparatus of claim 1, wherein the exterior wall of the radially outer portion includes a triangular cross-section.

4. The apparatus of claim 1, wherein the exterior wall of the radially outer portion includes a rectangular cross-section.

5. The apparatus of claim 1, wherein the exterior wall of the radially outer portion includes a hexagonal cross-section.

6. The apparatus of claim 1, wherein the lower portion has a shape of a frustum.

7. The apparatus of claim 1, further comprising a shaped charge being disposed in the upper portion of the through opening.

8. A method, comprising:

providing the apparatus of claim 1;

hand-loading an energetic charge in the upper portion of the through opening; and imparting a shockwave at an effective velocity and temperature on a gas in the through opening to ionize the gas for creating plasma and to drive the plasma.

9. The method of claim 8, further comprising, after the imparting step, impacting the plasma on a casing of an explosive ordnance containing an explosive to penetrate through the casing and, at least before causing an explosive event of the explosive within the casing, substantially consuming the explosive.

10. The method of claim 8, wherein the gas in the through opening is air.

11. The method of claim 9, wherein the energetic charge includes a detonation velocity of at least 7 mm/microsecond.

12. The method of claim 11, wherein the energetic charge has an effective velocity of at least 6 mm/microsecond.

13. A method, comprising:

providing the apparatus of claim 1;

loading a shaped charge in the upper portion of the through opening; and detonating the shaped charge for producing a jet that moves away from the shaped charge and through the lower portion of the through opening.

14. The method of claim 13, further comprising directing the jet from the lower opening to impact an explosive ordnance.

15. The method of claim 14, wherein the explosive ordnance is an improvised explosive device.

16. The method of claim 14, wherein the explosive ordnance is an unexploded ordnance.

* * * * *